US005964576A

United States Patent [19]

Fujita et al.

[11] Patent Number: 5,964,576

[45] Date of Patent: Oct. 12, 1999

[54] IMPELLER OF CENTRIFUGAL FAN

[75] Inventors: Hideki Fujita; Naoya Ito; Masahiro Mimura, all of Ibaragi, Japan

[73] Assignee: Japan Servo Co., Ltd., Ibaragi, Japan

[21] Appl. No.: 08/897,840

[22] Filed: Jul. 21, 1997

[30] Foreign Application Priority Data

| | | | |
|---|---|---|---|
| Jul. 26, 1996 | [JP] | Japan | 8-214142 |
| Jul. 26, 1996 | [JP] | Japan | 8-214143 |
| Jun. 19, 1997 | [JP] | Japan | 9-177784 |
| Jun. 19, 1997 | [JP] | Japan | 9-177785 |

[51] Int. Cl.[6] ..... F04D 29/30

[52] U.S. Cl. ..... 415/206; 416/183; 416/185; 416/223 B; 416/228; 416/237

[58] Field of Search ..... 415/206; 416/182, 416/183, 185, 186 R, 223 B, 228, 235, 237

[56] References Cited

U.S. PATENT DOCUMENTS

| | | | |
|---|---|---|---|
| 1,341,882 | 6/1920 | Criqui | 416/186 R |
| 4,647,271 | 3/1987 | Nagai et al. | 416/186 R |

FOREIGN PATENT DOCUMENTS

| | | | |
|---|---|---|---|
| 711615 | 6/1965 | Canada | 416/182 |
| 52-40808 | 3/1977 | Japan | 416/185 |
| 3-233196 | 10/1991 | Japan . | |
| 4-159498 | 6/1992 | Japan . | |
| 4-339199 | 11/1992 | Japan . | |

*Primary Examiner*—Christopher Verdier
*Attorney, Agent, or Firm*—Nilles & Nilles SC

[57] ABSTRACT

An impeller of a centrifugal fan having fifty or more blades of not larger than 250 mm in outer diameter which has a casing and a multi-blade impeller rotatably supported in the casing, wherein a centrifugal force is applied on air entered into an inlet formed on the casing when the impeller is rotated, and an air of high pressure is taken out through an outlet formed on a portion of the casing. An outer peripheral surface of the impeller is inclined or curved so as to have an inlet side large diameter portion and a blade holding base side small diameter portion, or is stepped so as to have an inlet side cylindrical outer peripheral surface of large diameter and a blade holding base side cylindrical outer peripheral surface of small diameter connected to the inlet side cylindrical outer peripheral surface. The inlet side cylindrical outer peripheral surface and the blade holding base side cylindrical outer peripheral surface are substantially the same height.

1 Claim, 13 Drawing Sheets

PRIOR ART FIG.21
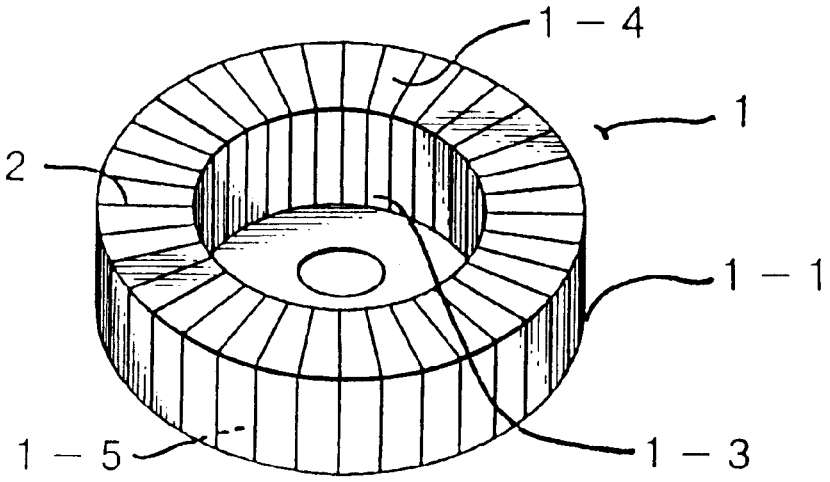
PRIOR ART FIG.22
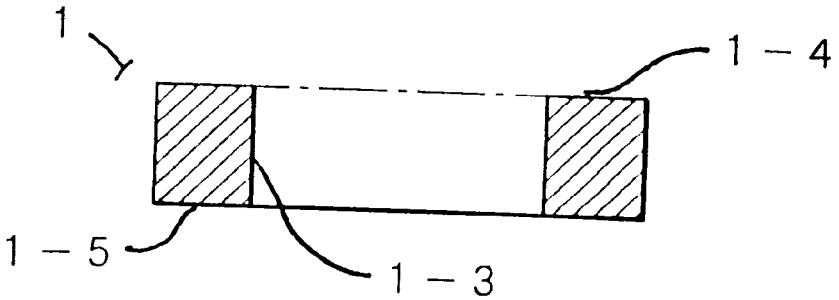

PRIOR ART FIG.23
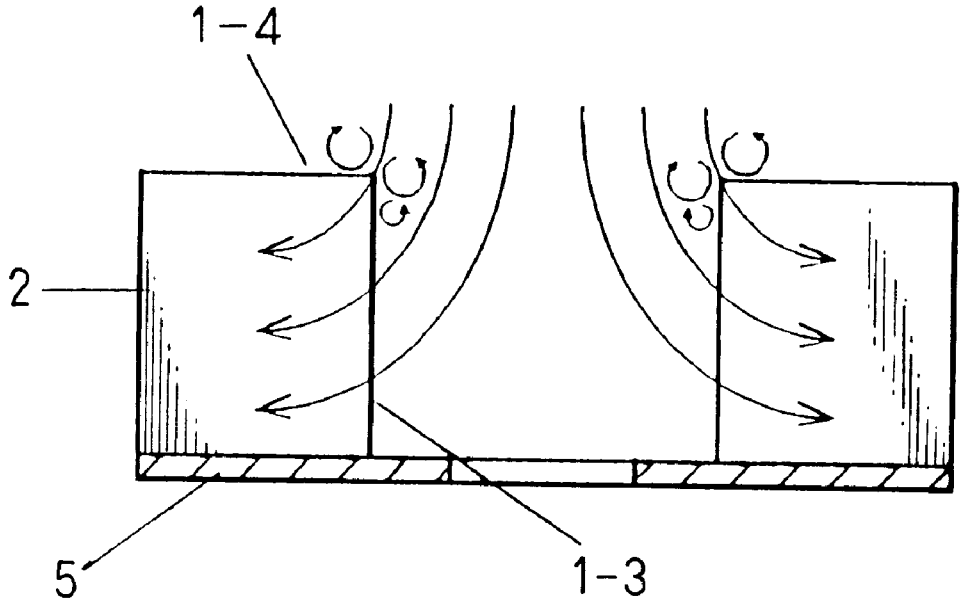

PRIOR ART FIG.24
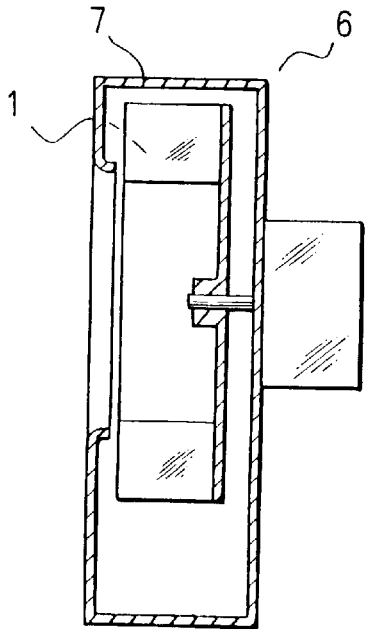
PRIOR ART FIG.25
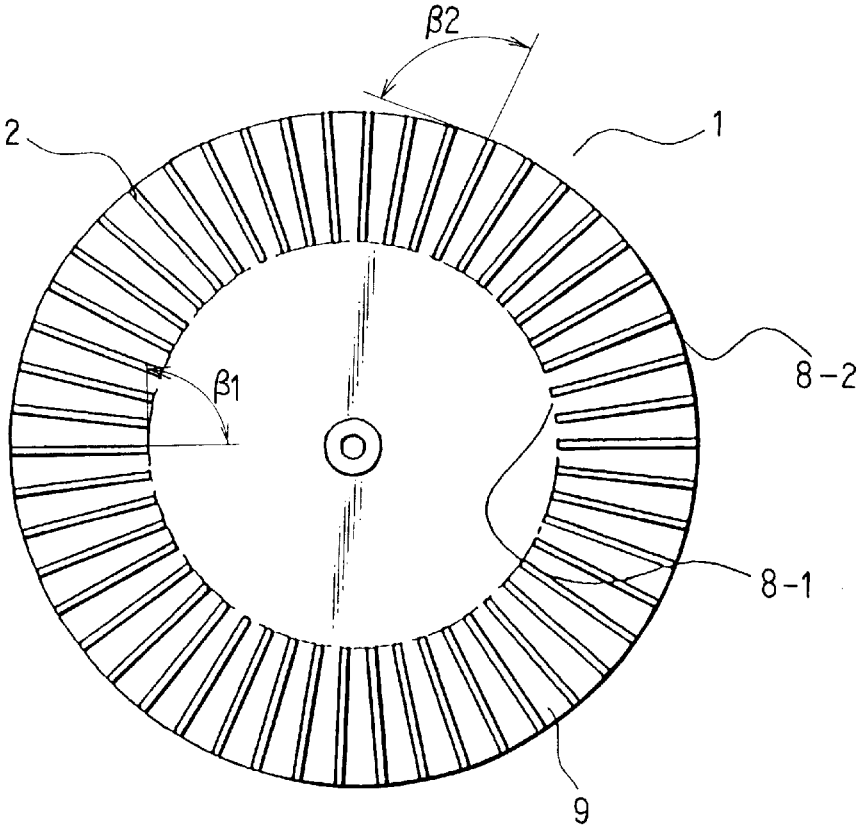

IMPELLER OF CENTRIFUGAL FAN

BACKGROUND OF THE INVENTION

1. Field of the Invention

The present invention relates to an impeller of a centrifugal fan, and more particularly to an improvement of a multi-blade impeller for use in a noiseless centrifugal fan.

2. Description of the Prior Art

The detailed construction of the conventional centrifugal fan has been publicly known. It has been known that if the number of blade of the impeller increases the generation of eddy current is reduced, so that the noise due to the rotation of the impeller is reduced. Especially, a small size centrifugal fan using a multi-blade impeller having ten or more blades is practically used in a point of view of the generation of eddy current.

FIG. 21 is a perspective view of a conventional multi-blade impeller 1 and FIG. 22 is a vertically sectional side view thereof.

A reference numeral 2 denotes a blade of the impeller 1, 1-1 denotes an outer peripheral surface of the impeller 1, 1-3 an inner peripheral surface of the impeller 1, 1-4 an inlet side end surface and 1-5 a blade holding base side end surface.

The present invention contemplates an impeller of 250 mm in diameter having more than fifty blades. In said conventional impeller 1, the outer and inner diameters of the inlet side end surface 1-4 are the same with that of the base side end surface 1-5, respectively.

In said conventional construction, the eddy current suppression effect can be obtained because a number of blades are used. However, there arises such a problem to be solved that an air current of high speed comes into an air current of low speed at the outer peripheral surface 1-1 of the impeller 1 because the current speed is increased gradually from the inlet side end surface 1-4 to the base side end surface 1-5, so that a further eddy current is generated.

Further, in said conventional construction, at a corner portion formed between the inner peripheral surface 1-3 and the inlet side end surface 1-4, such a phenomenon that an air current is braked away from the blades as shown in FIG. 23 is presented, so that an air current flowing into the blade is disturbed and the noise is generated.

As stated above, if the number of blade is increased the generation of the eddy current becomes small and the noise due to the rotation can be suppressed, but the distance between the adjacent blades becomes small, so that the inlet angle $\beta 1$ of the blade at the inner peripheral surface of the impeller must be set to 90° and the outlet angle $\beta 2$ of the blade at the outer peripheral surface of the impeller must be set to 90° according to the manufacturing requirement.

FIG. 24 shows a vertically sectional side view of a conventional centrifugal fan 6 having a multi-blade impeller 1 mounted rotatably in a casing 7. FIG. 25 shows a conventional multi-blade impeller 1 having fifty blades 2 of equal length arranged radially each extending from an inner peripheral edge 8-1 to an outer peripheral edge 8-2. A cross sectional area of a current path 9 relating to an air quantity is practically determined by a distance between adjacent blades in the vicinity of the inner peripheral edge 8-1, and it is well known that the air quantity becomes small if the blade number is increased.

If the blades are arranged radially, and the inlet angle $\beta 1$ of the blade at the inner peripheral surface of the impeller is set to 90° and the outlet angle $\beta 2$ of the blade at the outer peripheral surface of the impeller is set to 90° at the inlet side, such a phenomenon that an air current is braked away from the blades is presented, so that the noise is generated.

Further, at the outlet side, the eddy current is generated easily when the air is flowed, thereby causing the noise to be generated.

Further, in order to prevent the air quantity from being reduced, the blade number is reduced at the sacrifice of the reduction of noise, or the blade thickness is reduced in consideration of the durability of the blade in operation.

SUMMARY OF THE INVENTION

An object of the present invention is to provide a multi-blade impeller for use in a centrifugal fan, wherein an outer peripheral surface of the impeller is stepped so as to have an inlet side cylindrical outer peripheral surface of large diameter and a blade holding base side cylindrical outer peripheral surface of small diameter connected to the inlet side cylindrical outer peripheral surface.

The outer peripheral surface of the impeller can be formed of an inlet side inclined surface and the blade holding base side cylindrical outer peripheral surface. Both can be formed similar in height.

In the other impeller of a centrifugal fan, an inner peripheral surface of the impeller has an inlet side portion of large diameter, a cylindrical inner peripheral surface of small diameter extending from a blade holding base side, and an arcuate surface connecting the inlet side portion with the cylindrical inner peripheral surface.

According to the above construction, the turbulent air flow generating when the impeller is rotated can be suppressed, so that the noise at the outlet side can be reduced.

In the other impeller of a centrifugal fan, an inner peripheral surface of the impeller is stepped so as to have an inlet side cylindrical inner peripheral surface of large diameter and a blade holding base side cylindrical inner peripheral surface of small diameter connected to the inlet side cylindrical inner peripheral surface.

According to the above construction, the turbulent air flow generating at the inlet sid of the multi-blade impeller when the impeller is rotated can be suppressed, so that the noise at the outlet side can be reduced.

In the other impeller of a centrifugal fan, it is characterized in that the ratio of an inlet side inner diameter and an outlet side outer diameter of the impeller is in the range of 0.4 to 0.75, that an inlet angle $\beta 1$ of the blade is in the range of 30°~85°, that an outlet angle $\beta 2$ of the blade is not less than 100°, that an inlet side inner end of the blade is rounded with a radius of curvature of more than ¼ of the thickness of the blade, that the thickness of the blade becomes small gradually toward an outlet side outer end, and the outer end thereof is pointed, or rounded with a small radius of carvature, and that at least one of the front and back surfaces of the blade is formed as a streamline.

According to the above construction, the air flow in the multi-blade impeller for use in the small size centrifugal fan becomes smooth, air braking away phenomenon at the inlet side or the eddy current at the outlet side can be suppressed, so that the noise can be reduced.

In an other impeller of a centrifugal fan, the blade comprises a long main blade element extending from an outer peripheral edge to an inner peripheral edge of the impeller, and a short auxiliary blade element extending from the outer peripheral edge toward the inner peripheral edge. The length of the auxiliary blade element is one half of that of the main blade element. An inlet side inner end of the blade is rounded with a radius of curvature of more than ¼ of the thickness of the blade. The thickness of the blade becomes small gradually toward an outlet side outer end, and the outer end thereof is pointed, or rounded with a small radius of curvature, and at least one of the front and back surfaces of the blade is formed as a streamline.

According to the above construction, a relatively large air path is formed at the outlet side outer peripheral edge so that the noise can be reduced, and a relatively narrow air path is formed at the inlet side inner peripheral edge so that the air quantity can be increased.

The above and other objects as well as advantageous features of the invention will become apparent from a consideration of the following description of the preferred embodiments taken in conjunction with the appended claims, and the accompanying drawings.

BRIEF DESCRIPTION OF THE DRAWINGS

FIG. 21 is a perspective view of a conventional multi-blade impeller.

FIG. 22 is a vertically sectional side view of the impeller of FIG. 21;

FIG. 23 is a view of the impeller of FIG. 21;

FIG. 24 is a vertically sectional side view of a conventional centrifugal fan;

FIG. 25 is a front view of the conventional impeller.

DESCRIPTION OF THE PREFERRED EMBODIMENTS

A first embodiment of the present invention will be explained with reference to FIGS. 1 and 2.

Figure 1:
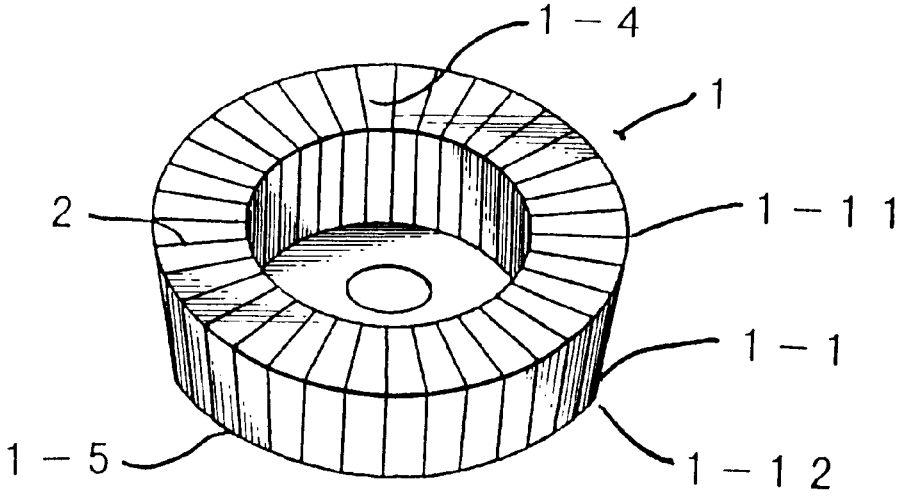
FIG. 1 is a perspective view of a multi-blade impeller of the present invention.
Figure 2:
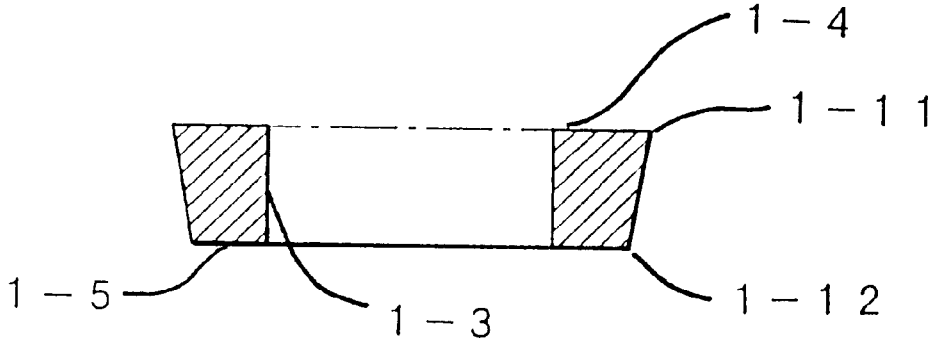
FIG. 2 is a vertically sectional side view of the impeller of FIG. 1.

FIG. 1 shows a perspective view of a multi-blade impeller 1 of the present invention and FIG. 2 shows a vertically sectional front view thereof.

The multi-blade impeller 1 of the present invention shown in FIGS. 1 and 2 has fifty or more blades of an outer diameter of not larger than 250 mm, and is used for a small size centrifugal fan.

The outer diameter of an outer peripheral surface 1-1 of the impeller 1 is reduced gradually from a portion 1-11 at inlet side end surface 1-4 toward a portion 1-12 at a blade holding base side end surface 1-5.

According to said impeller 1, an air current of low speed at the inlet side end surface 1-4 flows into the blades through the portion 1-11 of large diameter of the impeller 1 and is accelerated by the blades of large diameter. An air current of high speed flows into the blades through the portion 1-12 of small diameter of the impeller 1 and is accelerated by the blades of small diameter. Accordingly, both air currents become similar in speed to each other at an outlet portion of the impeller 1, so that the eddy current is prevented from being generated.

Figure 3:
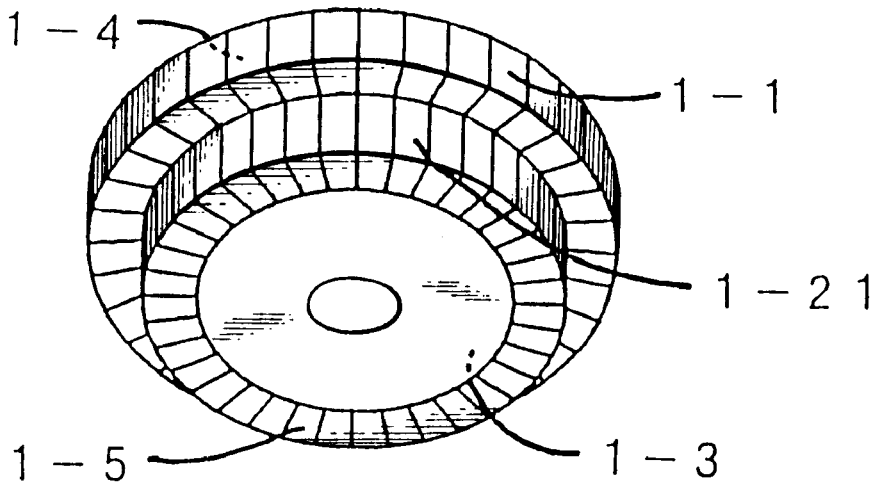
FIG. 3 is a perspective view of a multi-blade impeller of another embodiment of the present invention.
Figure 4:
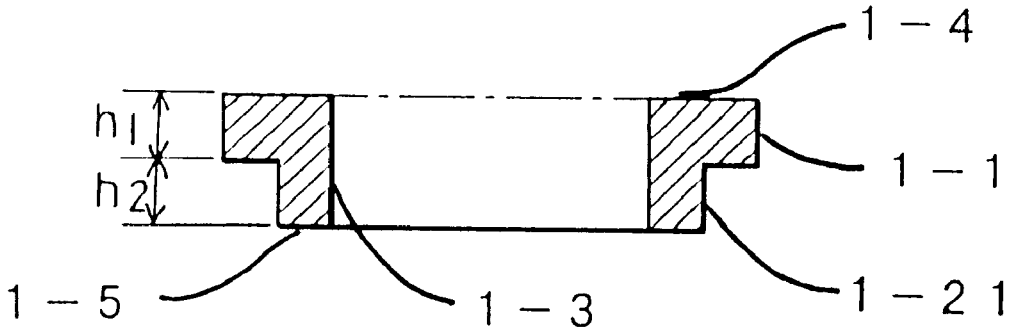
FIG. 4 is a vertically sectional side view of the impeller of FIG. 3.

FIG. 3 shows a second embodiment of the impeller of the present invention wherein an outer peripheral surface of the impeller 1 has an outer peripheral cylindrical surface 1-1 of large diameter at an inlet side and an outer peripheral cylindrical surface 1-21 of small diameter at a blade holding base side making a step. The heights $h_1$ and $h_2$ of said outer peripheral cylindrical surfaces 1-1 and 1-21 are determined similar to each other as shown in FIG. 4. However, the heights $h_1$ and $h_2$ can be set different from each other.

In this embodiment, similar to the first embodiment, the air currents become similar in speed to each other at the outlet portion of the impeller and the generation of the eddy current is suppressed.

Figure 5:
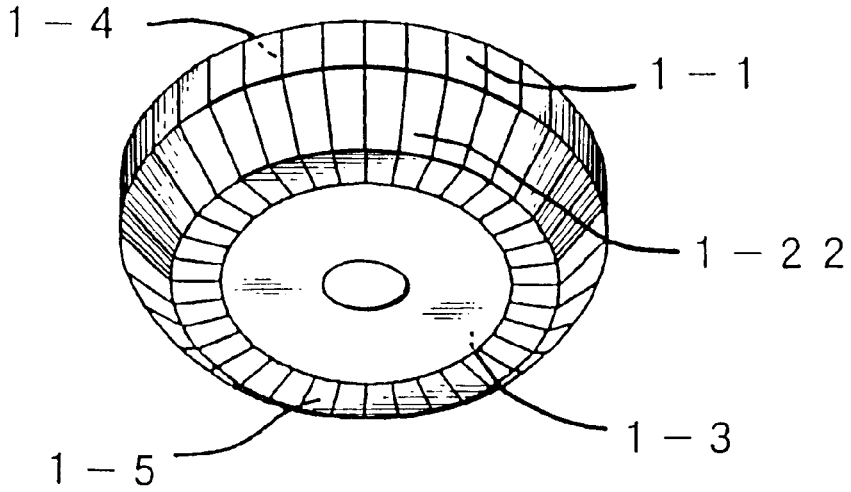
FIG. 5 is a perspective view of a multi-blade impeller of another embodiment of the present invention.
Figure 6:
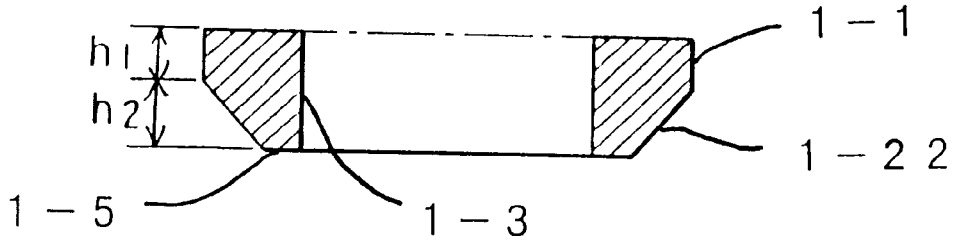
FIG. 6 is a vertically sectional side view of the impeller of FIG. 5.

FIG. 5 shows a third embodiment of the impeller of the present invention wherein an outer peripheral surface of the impeller 1 has an outer peripheral cylindrical surface 1-1 of large diameter at an inlet side and an inclined surface 1-22 connecting between said outer peripheral cylindrical surface 1-1 and a blade holding base side end surface 1-5 of small outer diameter. The heights $h_1$ and $h_2$ of said outer peripheral cylindrical surface 1-1 and the inclined surface 1-22 are determined similar to each other as shown in FIG. 6. However, the heights $h_1$ and $h_2$ can be set different from each other.

In this embodiment, similar to the first embodiment, the air currents become similar in speed to each other at the outlet portion of the impeller and the generation of the eddy current is suppressed.

Figure 7:
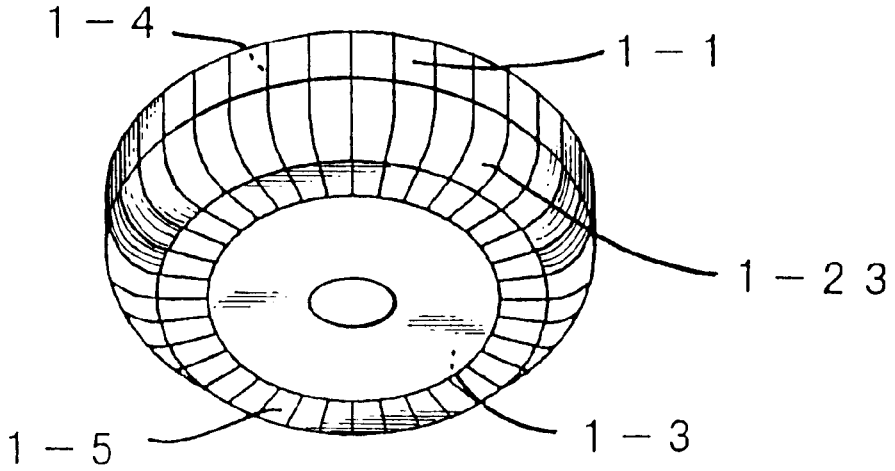
FIG. 7 is a perspective view of a multi-blade impeller of another embodiment of the present invention.
Figure 8:
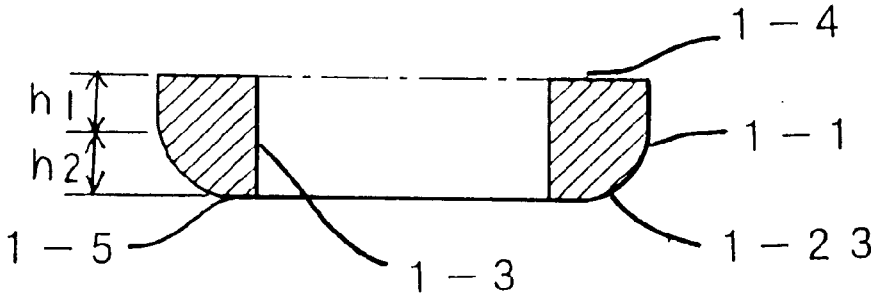
FIG. 8 is a vertically sectional side view of the impeller of FIG. 7.

FIG. 7 shows a fourth embodiment of the impeller of the present invention wherein an outer peripheral surface of the impeller 1 has an outer peripheral cylindrical surface 1-1 of large diameter at an inlet side and an inclined arcuate surface 1-23 connecting between said outer peripheral cylindrical surface 1-1 and a blade holding base side end surface 1-5 of small outer diameter. The heights $h_1$ and $h_2$ of said outer peripheral cylindrical surface 1-1 and the inclined arcuate surface 1-23 are determined similar to each other as shown in FIG. 8. However, the heights $h_1$ and $h_2$ can be set different from each other.

In this embodiment, similar to the first embodiment, the air currents become similar in speed to each other at the outlet portion of the impeller and the generation of the eddy current is suppressed.

A fifth embodiment of the present invention will be explained with reference to FIGS. 9 and 10.

Figure 9:
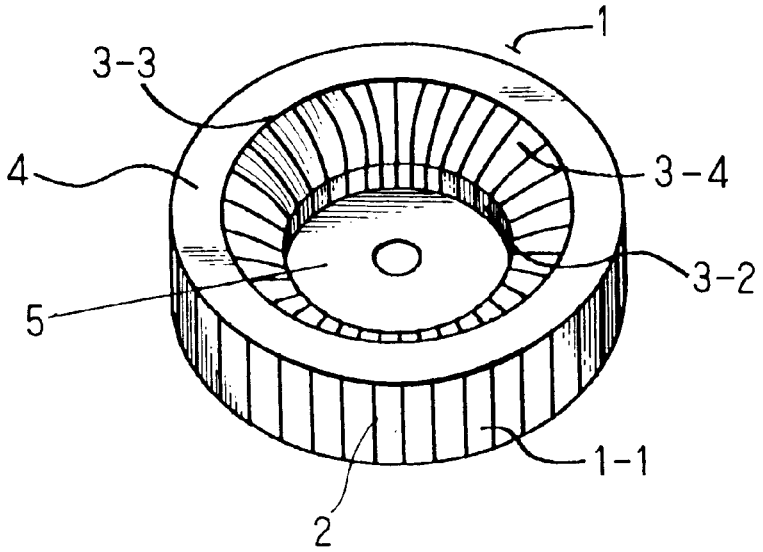
FIG. 9 is a perspective view of a multi-blade impeller of another embodiment of the present invention.
Figure 10:
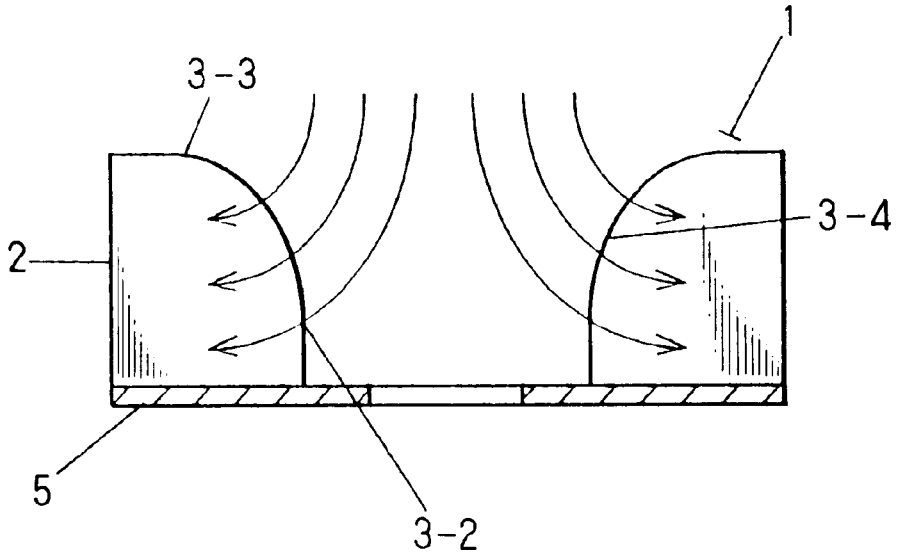
FIG. 10 is a vertically sectional side view of the impeller of FIG. 9.

The multi-blade impeller 1 of the present invention shown in FIGS. 9 and 10 has fifty or more blades having an outer diameter of not larger than 250 mm, and is used for a small size centrifugal fan.

A number of blades 2 are held between an inlet side end plate 4 and a blade holding base plate 5 separated axially from said inlet side end plate 4. A reference numeral 3-3 denotes an inlet side large diameter portion of an inner peripheral surface of the impeller 1, 3-2 denotes a cylindrical inner peripheral surface of small diameter of the impeller 1 extending from the blade holding base plate 5, and 3-4 denotes an arcuate surface connecting between said inlet side portion 3-3 and the cylindrical inner peripheral surface 3-2.

The arcuate surface 3-4 and the cylindrical inner peripheral surface 3-2 are the same substantially in height, but can be set different from each other.

In said embodiment, as shown in FIG. 10, the inlet side portion of large diameter 3-3 is connected through the arcuate surface 3-4 with the cylindrical inner peripheral surface of small diameter 3-2 extending from the blade holding base plate 5, so that no corner is formed at the inlet side portion 3-3. Accordingly, the air is prevented from being braked away from the blades at inlet side portion 3-3 and the generation of turbulent air flow at the outlet side portion is reduced, so that the generation of noise can be suppressed.

In the small size multi-blade impeller, the distance between the adjacent blades is small so that the generation of the eddy current can be suppressed and the noise is reduced. However, if the air current at the inlet side portion 3-3 is disturbed, the eddy current suppressing function is offset.

Accordingly, the present invention is effective to apply to a small size multi-blade impeller having fifty or more blades having the outer diameter of not larger than 250 mm, because the air current at the inlet side portion 3-3 is not disturbed so that the eddy current can be suppressed and the noise is reduced.

Figure 11:
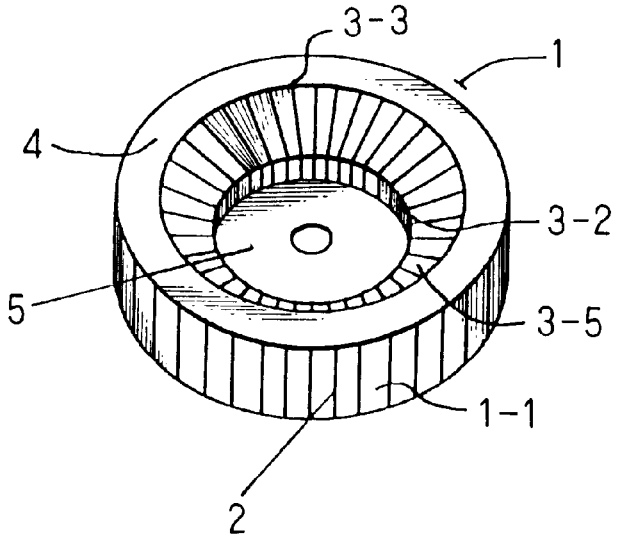
FIG. 11 is a perspective view of a multi-blade impeller of another embodiment of the present invention.

FIG. 11 shows a sixth embodiment of the small size multi-blade impeller of the present invention wherein an inner peripheral surface of the impeller 1 has an inlet side portion 3-3 of large diameter and an inclined surface 3-5 connecting between said inlet side portion 3-3 and a cylindrical inner peripheral surface 3-2 of small diameter extending from a blade holding base plate 5 similar to said fifth embodiment.

The inclined surface 3-5 and the cylindrical inner peripheral surface 3-2 are the same substantially in height, but can be set different from each other.

The reason why the eddy current is suppressed is the same as in said fifth embodiment.

Figure 12:
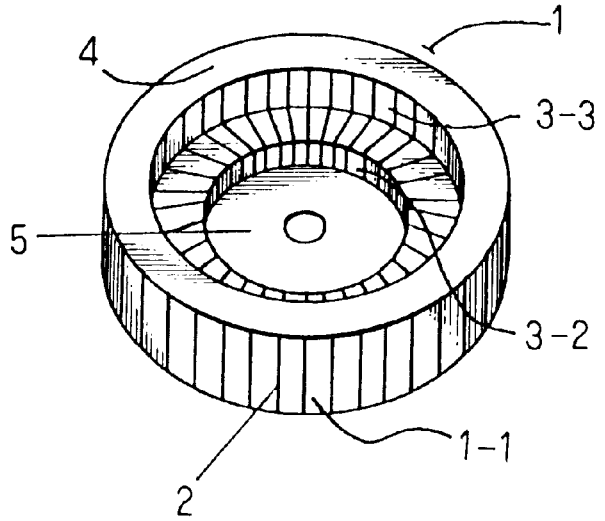
FIG. 12 is a perspective view of a multi-blade impeller of another embodiment of the present invention.

FIG. 12 shows a seventh embodiment of the small size multi-blade impeller of the present invention wherein an inner peripheral surface of the impeller 1 has an inlet side cylindrical inner peripheral surface 3-3 of large diameter and a cylindrical inner peripheral surface 3-2 of small diameter extending from a blade holding base plate 5 making a step.

It is preferable that the cylindrical inner peripheral surface 3-3 of large diameter and the cylindrical inner peripheral surface 3-2 of small diameter are the same substantially in height, but may be set different from each other.

The reason why the eddy current is suppressed is the same as in said fifth embodiment.

Figure 13:
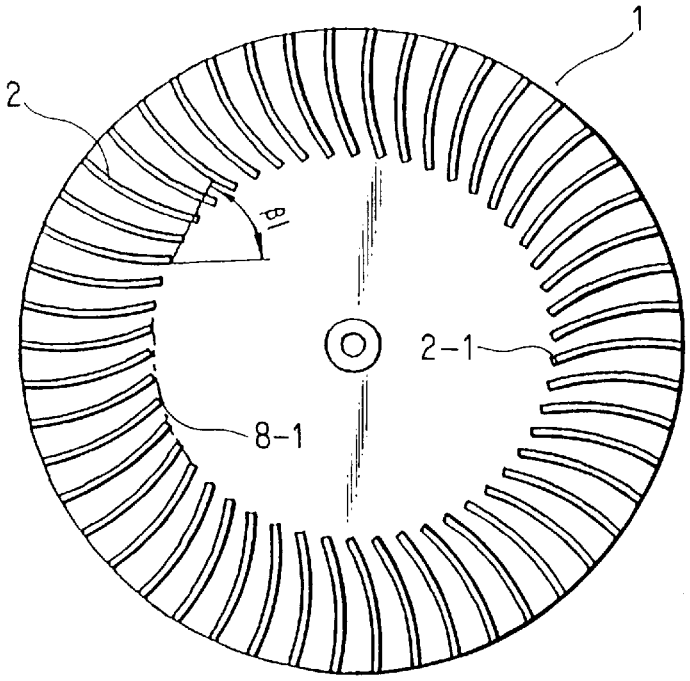
FIG. 13 is a front view of a multi-blade impeller of another embodiment of the present invention.

FIG. 13 shows an eighth embodiment of the present invention wherein an inlet angle β1 of the blade 2 at an inner peripheral edge 8-1 of the impeller 1 is set in the range of 30°~85°.

In this embodiment, if the inlet angle β1 of the blade 2 is reduced the air flowing into the blades from the inner peripheral edge 8-1 is prevented from being braked away or detached from an inner peripheral edge 2-1 of the blade 2. It is preferable that the inlet angle β1 is set in the range of 30°~85° practically, because the air current becomes smooth and the noise due to the air braking away can be suppressed.

Figure 14:
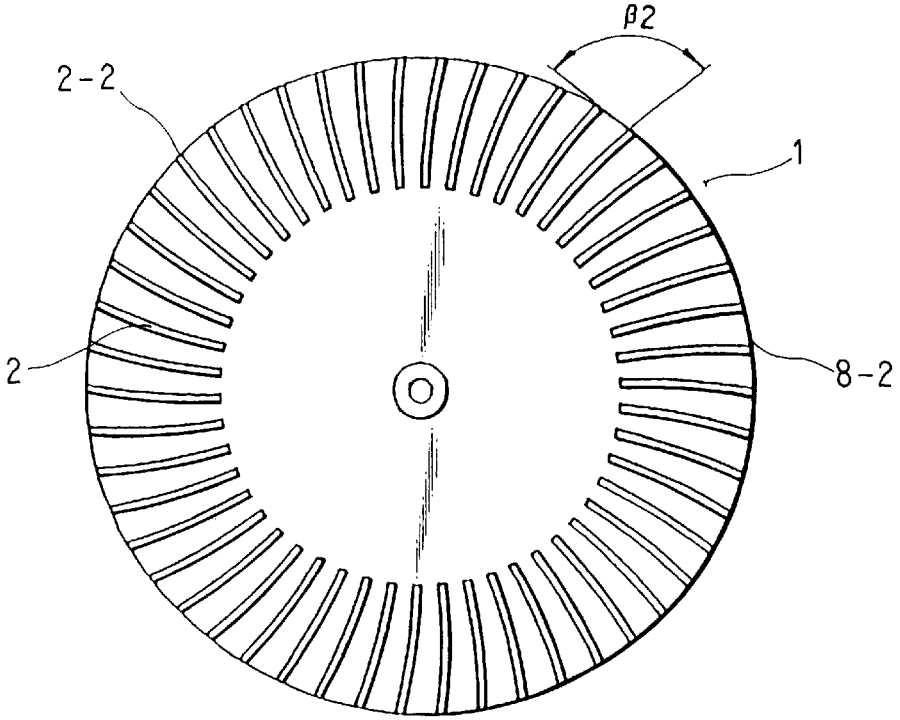
FIG. 14 is a front view of a multi-blade impeller of another embodiment of the present invention.

FIG. 14 shows a ninth embodiment of the present invention wherein an outlet angle β2 of the blade 2 is set more than 100°.

In this embodiment, the outlet angle β2 is large so that the eddy current which is generated at an outer peripheral edge 2-2 when an air current accelerated by the rotation of the impeller 1 is discharged from an outer peripheral edge 8-2 of the impeller 1 can effectively be suppressed.

Figure 15:
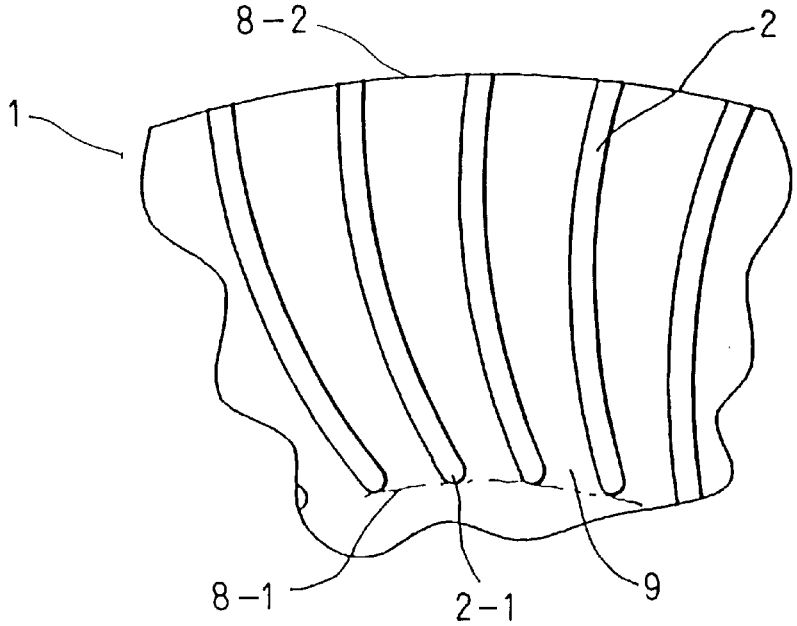
FIG. 15 is a front view of an enlarged portion of the impeller of another embodiment of the present invention.

FIG. 15 shows a tenth embodiment of the multi-blade impeller of the present invention.

In the small size multi-blade centrifugal fan, an air path 9 is limited according to the increase of the number and/or the thickness of the blade. Especially, the figure of an inner peripheral end 2-1 of the blade 2 is related to the generation of the turbulent flow of air. It is effective that both sides of the inner peripheral end are rounded with a radius of curvature of more than ¼ of the thickness of the blade 2 in order to suppress the turbulent flow of air.

Figure 16:
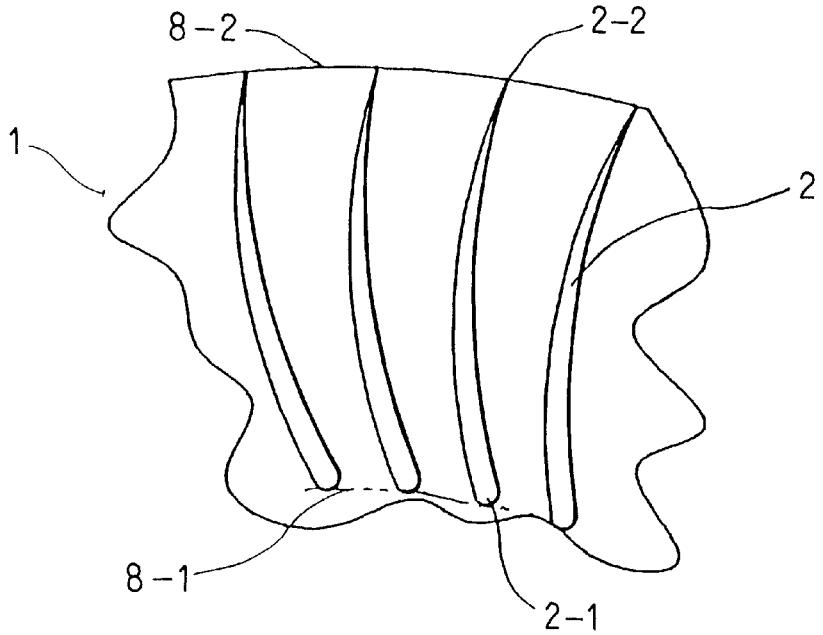
FIG. 16 is a front view of an enlarged portion of the impeller of another embodiment of the present invention.

FIG. 16 shows an eleventh embodiment of the impeller of the present invention wherein the noise generated at the outlet side Is more suppressed.

In this embodiment, an outer peripheral end 2-2 of the blade 2 is sharpened or rounded with a small radius of curvature in order to make the outer peripheral end 2-2 small in thickness, so that the eddy current or so-called boundary layer formed due to the thickness of the blade 2 at the outer peripheral edge 8-2 of the impeller 1 is removed and that the noise is suppressed.

It goes without saying that it is effective to form the surface of the blade 2 between the inlet angle β1 and the outlet angle β2 as a streamline or a curve in order to make air currents smooth.

According to the present invention, a noiseless small size centrifugal fan can be obtained by improving the inlet angle β1 and the outlet angle β2, as well as the blade end surface configuration.

Figure 17:
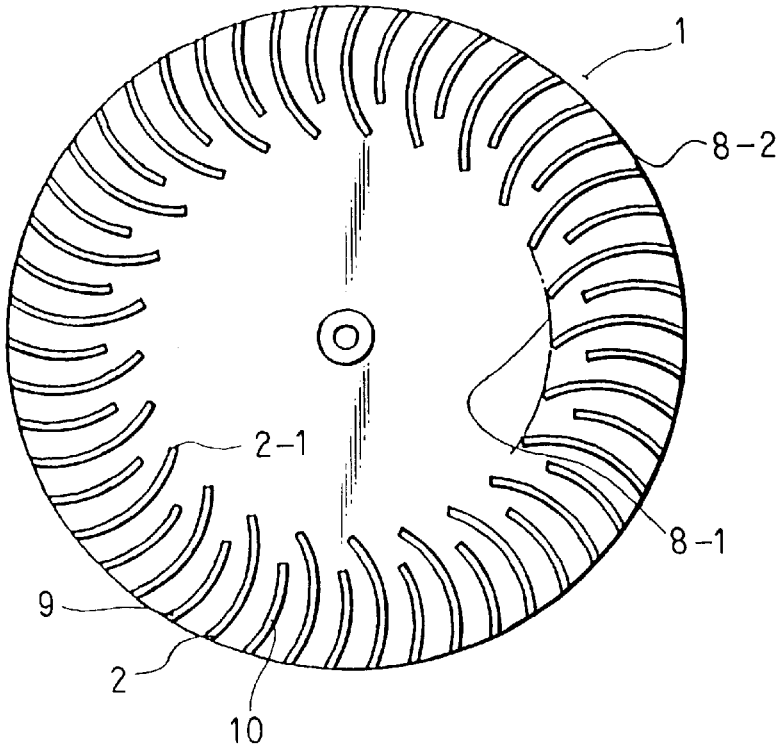
FIG. 17 is a front view of a multi-blade impeller of another embodiment of the present invention.

FIG. 17 shows a twelfth embodiment of the multi-blade impeller of the present invention wherein the total number of main blades 2 and auxiliary blades 10 at an outer peripheral edge 8-2 of the impeller 1 is 50 similar to that of the conventional impeller shown in FIG. 25, and an inner peripheral edge 8-1 is formed only twenty-five main blades 2.

As is apparent from the comparison with the conventional impeller shown in FIG. 25, in this embodiment, each of twenty-five short auxiliary blades 10 which are not extended to the inner peripheral edge 8-1 is inserted between adjacent two long main blades 2, In this embodiment, an air at the inner peripheral edge 8-1 of the impeller 1 flows into an air path at an inner peripheral end 2-1 of the blade 2. It is needles to say that the impeller of the present invention has effects superior than the conventional impeller shown in FIG. 25, because the air at the inner peripheral edge 8-1 flows into the air path at the inner peripheral end 2-1 according to the rotation of the multi-blade impeller 1, and the area of the air path at the inlet side depends on the distance between adjacent two main blade 2.

Figure 18:
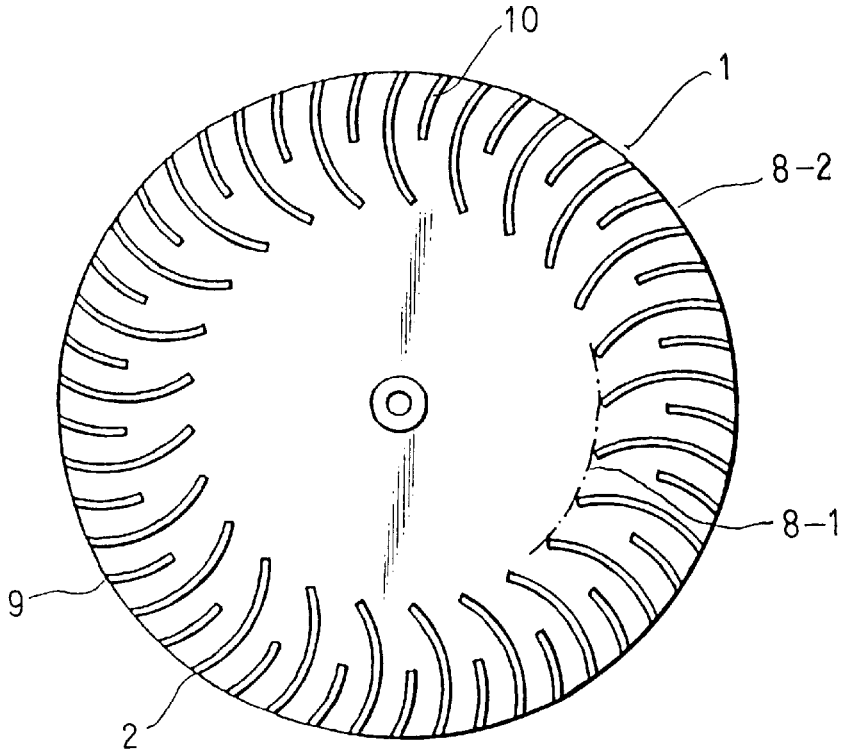
FIG. 18 is a front view of a multi-blade impeller of another embodiment of the present invention.

FIG. 18 shows a further embodiment of the present invention wherein the length of an auxiliary blade 10 is about one half of that of the main blade 2. According to this embodiment, the quantity of air can be increased and the noise can be suppressed.

In a small size multi-blade centrifugal fan, an air path 9 is limited according to the increase of the number and/or the thickness of the blade. Especially, the figure of an inner peripheral end 2-1 of the blade 2 is related to the generation of the turbulent flow of air. It is effective that the inner peripheral end 2-1 is rounded as shown in FIG. 19 in order to suppress the turbulent flow of air.

Figure 19:
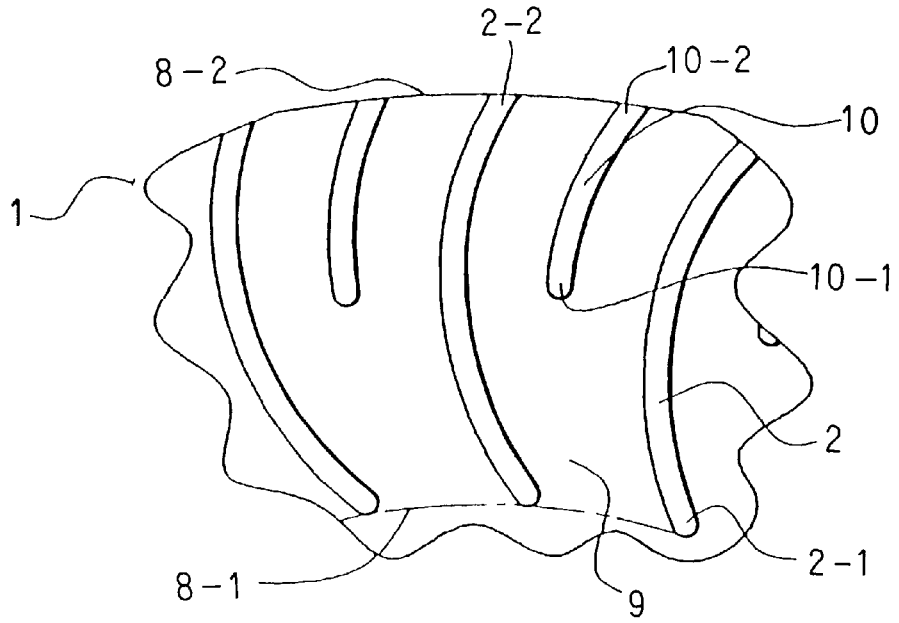
FIG. 19 is a front view of an enlarged portion of the impeller of another embodiment of the present invention.

It is also effective that an inner peripheral end 10-1 of the auxiliary blade 10 is rounded as shown in FIG. 19.

Figure 20:
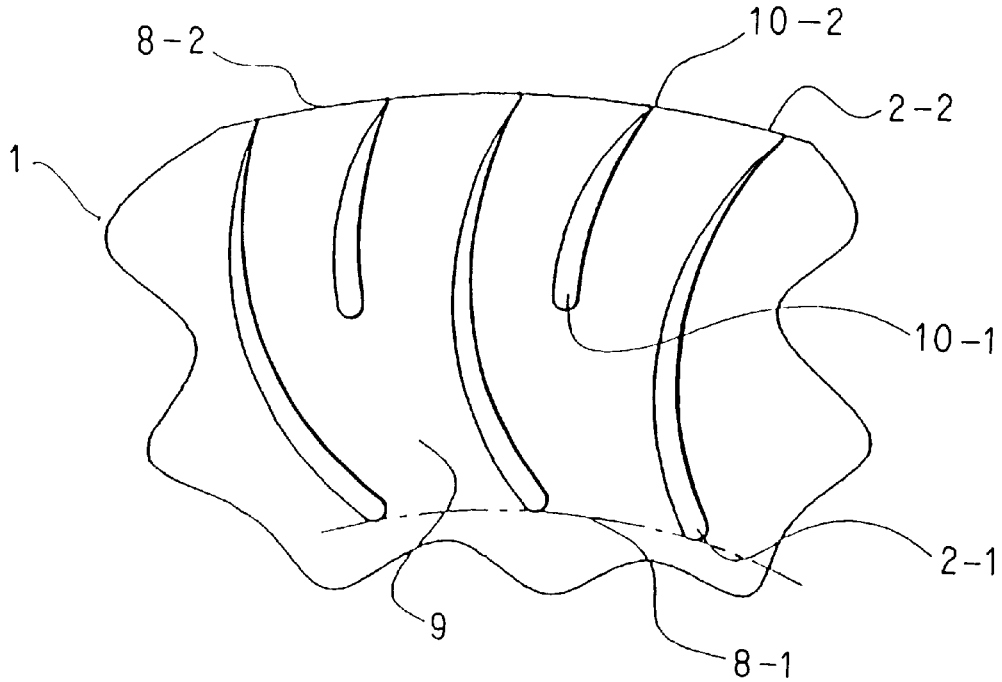
FIG. 20 is a front view of an enlarged portion of the impeller of the other embodiment of the present invention.

It is also effective as shown in FIG. 20 that the outer peripheral ends 2-2 and 10-2 of the blades 2 and 1.0 are sharpened in order to make the outer peripheral ends 2-2 and 10-2 small in thickness, so that the eddy current or so-called boundary layer formed due to the thickness of the blade 2 or 10 at an outer peripheral edge 8-2 of the impeller 1 is removed and that the noise is suppressed.

It goes without saying that it is effective to form the surface of the blade as a streamline or a curve in order to make air currents smooth.

According to the centrifugal fan of the present invention, the noise can be suppressed by increasing the number of blade at the outer peripheral edge and by improving the configurations of the blade ends at the outlet side inner and outer peripheral edges, as well as by enlarging the air path and increasing the quantity of air by reducing the number of blades at the inlet side inner peripheral edge.

While the invention has been particularly shown and described with reference to the preferred embodiments thereof, it will be understood by those skilled in the art that various changes in form and details may be made therein without departing from the spirit and scope of the invention as defined by the appended claims.

What is claimed is:

1. In an impeller of a centrifugal fan having a casing and a multi-blade impeller rotatably supported in said casing, said impeller being of fifty or more blades of not larger than 250 mm in outer diameter, wherein, when sad impeller is rotated, a centrifugal force is applied on air entered into an inlet formed on said casing and air of high pressure is taken out through an outlet formed on a portion of said casing, the improvement characterized in that an outer peripheral surface of the impeller has 1) an inlet side cylindrical outer peripheral surface which is of a large diameter, 2) a blade holding base outer peripheral surface which is of a smaller diameter than said cylindrical outer peripheral surface, and 3) an inclined arcuate surface which is connected to the cylindrical outer peripheral surface and which gradually tapers in diameter toward said blade holding base outer peripheral surface, and wherein said cylindrical outer peripheral surface and said inclined arcuate surface are substantially the same height.

* * * * *